US010573109B2

(12) United States Patent
Lu et al.

(10) Patent No.: US 10,573,109 B2
(45) Date of Patent: Feb. 25, 2020

(54) ELECTRIC LOCK AND METHOD FOR ADDING A USER OF THE SAME

(71) Applicant: TAIWAN FU HSING INDUSTRIAL CO., LTD., Kaohsiung (TW)

(72) Inventors: Shih-Min Lu, Kaohsiung (TW); Fu-Chih Huang, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 16/232,055

(22) Filed: Dec. 26, 2018

(65) Prior Publication Data

US 2019/0206167 A1 Jul. 4, 2019

Related U.S. Application Data

(63) Continuation-in-part of application No. 15/966,001, filed on Apr. 30, 2018, now Pat. No. 10,169,940.

(30) Foreign Application Priority Data

Jan. 4, 2018 (TW) ..... 107100342 A
Dec. 25, 2018 (TW) ..... 107146949 A

(51) Int. Cl.
*G07C 9/00* (2006.01)

(52) U.S. Cl.
CPC ..... *G07C 9/00571* (2013.01); *G07C 9/0069* (2013.01); *G07C 9/00103* (2013.01); *G07C 2009/00769* (2013.01)

(58) Field of Classification Search
CPC ..... G07C 9/00309; G07C 9/00571
USPC ..... 340/5.6–5.65
See application file for complete search history.

(56) References Cited

U.S. PATENT DOCUMENTS 8,990,927 B2 * 3/2015 Al-Azzawi ..... G07C 9/00182 726/19
9,728,022 B2 8/2017 Gengler
2007/0197261 A1 * 8/2007 Humbel ..... G06Q 30/00 455/558
2012/0272301 A1 * 10/2012 LoBean ..... G06F 21/31 726/6
2012/0306617 A1 * 12/2012 Tung ..... G07C 9/00309 340/5.54
2013/0191908 A1 7/2013 Klein
2014/0375422 A1 * 12/2014 Huber ..... G07C 9/00174 340/5.61

(Continued)

FOREIGN PATENT DOCUMENTS

CA 2 955 795 A1 2/2016
TW 201232417 A1 8/2012

(Continued)

*Primary Examiner* — Allen T Cao
(74) *Attorney, Agent, or Firm* — Winston Hsu

(57) ABSTRACT

A method for adding a user of an electric lock includes receiving a temporary code; establishing a connection between a portable device of the user and the electric lock; inputting and transmitting the temporary code to the electric lock via the portable device; the electric lock determining if the temporary code matches a default password; inputting a user information of the portable device via the portable device when the temporary code matches the default password; and storing the user information in the electric lock, so that the portable device is allowed to drive the electric lock to perform an action.

20 Claims, 9 Drawing Sheets

(56) References Cited

U.S. PATENT DOCUMENTS

| | | | | |
|---|---|---|---|---|
| 2016/0217637 | A1 | 7/2016 | Gengler | |
| 2019/0122293 | A1 * | 4/2019 | Minsely | G06Q 30/0645 |

FOREIGN PATENT DOCUMENTS

| | | | |
|---|---|---|---|
| TW | 201439991 | A | 10/2014 |
| TW | 1491790 | B | 7/2015 |
| TW | M557769 | U | 4/2018 |
| TW | 201837764 | A | 10/2018 |
| WO | 20161028697 | A1 | 2/2016 |

* cited by examiner

ELECTRIC LOCK AND METHOD FOR ADDING A USER OF THE SAME

CROSS REFERENCE TO RELATED APPLICATIONS

This application is a continuation-in-part of U.S. application Ser. No. 15/966,001, filed Apr. 30, 2018. This application claims the benefit of U.S. application Ser. No. 15/966,001, which was filed on Apr. 30, 2018, and is incorporated herein by reference.

BACKGROUND OF THE INVENTION

1. Field of the Invention

The present invention relates to an electric lock and a method for adding a user of the same. More particularly, the present invention relates to an electric lock which does not need a manager to operate in person for adding a new user and a method for adding the new user of the same.

2. Description of the Prior Art

In convention, when an electric lock needs to add a user, a manager of the electric lock has to establish a connection between a portable device thereof and the electric lock, and the manager inputs a manager password via the portable device to enter the electric lock for adding the information related to the user. Afterwards, the electric lock stores a MAC address of a portable device of the user, so that the portable device of the user is allowed to unlock the electric lock. In other words, when setting the electric lock, the portable devices of the manager and the user must be in front of the electric lock at the same time, which results in inconvenience in management for the manager.

SUMMARY OF THE INVENTION

A purpose of the present invention is to provide an electric lock and a method for adding a user of the electric lock for solving above drawbacks.

According to an embodiment of the present invention, a method for adding a user of an electric lock includes receiving a temporary code; establishing a connection between a portable device of the user and the electric lock; inputting and transmitting the temporary code to the electric lock via the portable device; the electric lock determining if the temporary code matches a default password; inputting a user information of the portable device via the portable device when the temporary code matches the default password; and storing the user information in the electric lock, so that the portable device is allowed to drive the electric lock to perform an action.

According to an embodiment of the present invention, an electric lock, when establishing a connection with a portable device of a user being added, being configured to receive a temporary code transmitted from the portable device; determine if the temporary code matches a default password; receive a user information of the portable device inputted via the portable device when the temporary code matches the default password; and store the user information, so that the portable device is allowed to drive the electric lock to perform an action.

According to the aforementioned embodiments, the user who is desired/needed to be added as a new user of the electric lock can add himself/herself as the new user of the electric lock via the user's own portable device, and it does not require the manager to operate in person at the same time. Accordingly, the convenience for managing the electric lock can be enhanced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
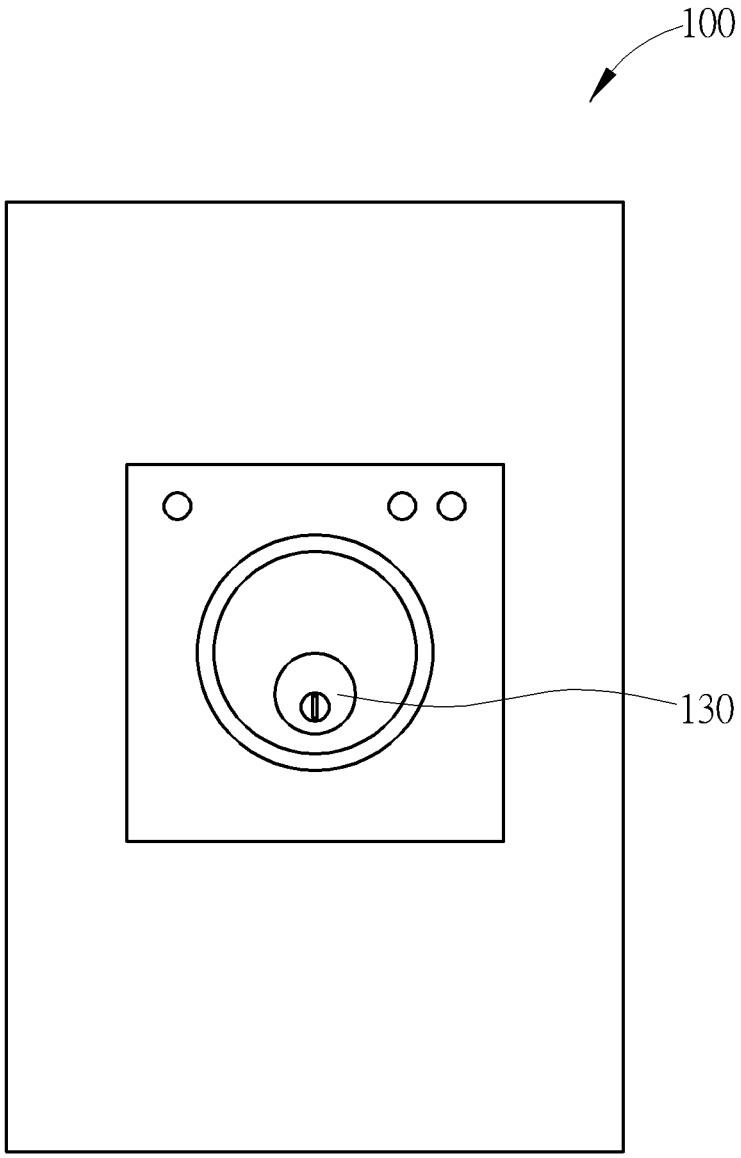
FIG. 1 is a schematic diagram of an electric lock according to an embodiment of the present invention.
Figure 2:
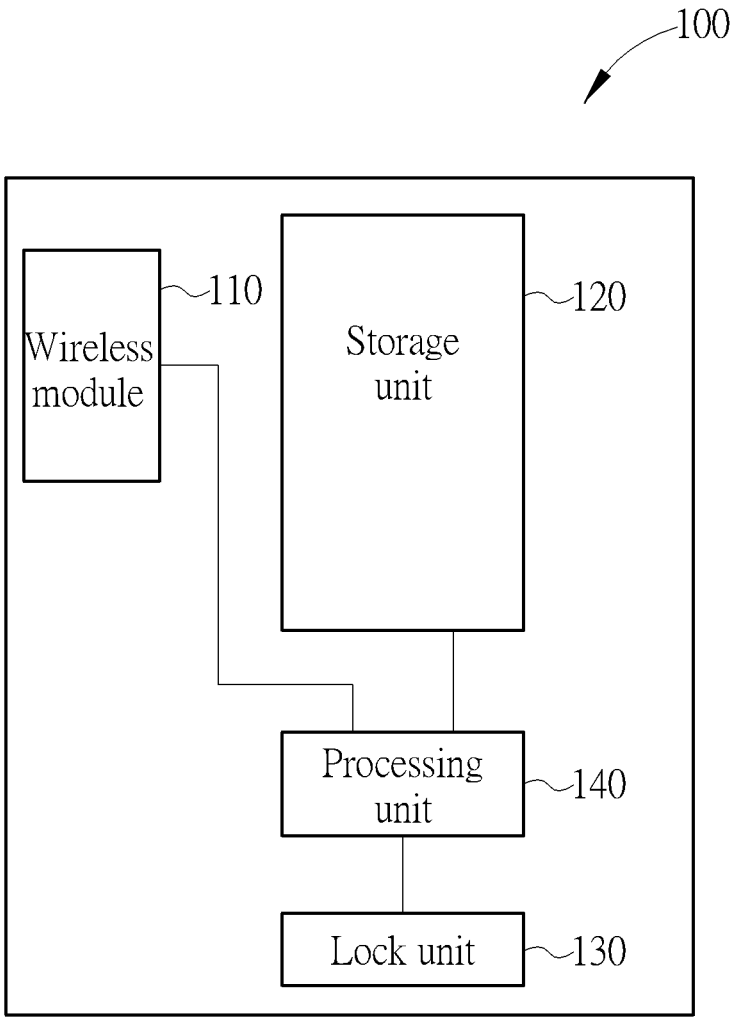
FIG. 2 is a functional block diagram of the electric lock of FIG. 1.

Please refer to FIG. 1 and FIG. 2. FIG. 1 is a schematic diagram of an electric lock 100 according to an embodiment of the present invention. FIG. 2 is a functional block diagram of the electric lock 100 of FIG. 1. As shown in FIG. 1 and FIG. 2, the electric lock 100 includes a wireless module 110, a storage unit 120, a lock unit 130 and a processing unit 140. The wireless module 110 can be a Bluetooth module or other wireless communication modules. The storage unit 120 is configured to store data (such as a manager password, an authentication code or a unique identification information of the portable device). The storage unit 120 can be, but is not limited to, a read-only memory (ROM), a random access memory (RAM) or a combination thereof. The lock unit 130 is configured to perform a locking operation or an unlocking operation for an object (such as a door). The lock unit 130 can be a conventional lock mechanism, which can include a lock tongue, a plate, a transmission mechanism (including a motor, a gear, etc.) and a clutch mechanism, wherein the clutch mechanism is coordinated with the plate to allow the transmission mechanism to be capable of driving the lock tongue so as to lock or unlock the door. However, the present invention is not limited thereto. The lock mechanisms which can electrically control the locking operation or the unlocking operation of the door can be used as the lock unit 130 of the present invention. The processing unit 140 is electrically connected to the wireless module 110, the storage unit 120 and the lock unit 130, and configured to control the operation of the electric lock 100. The processing unit 140 can be, but is not limited to, a central processing unit (CPU).

Figure 3:
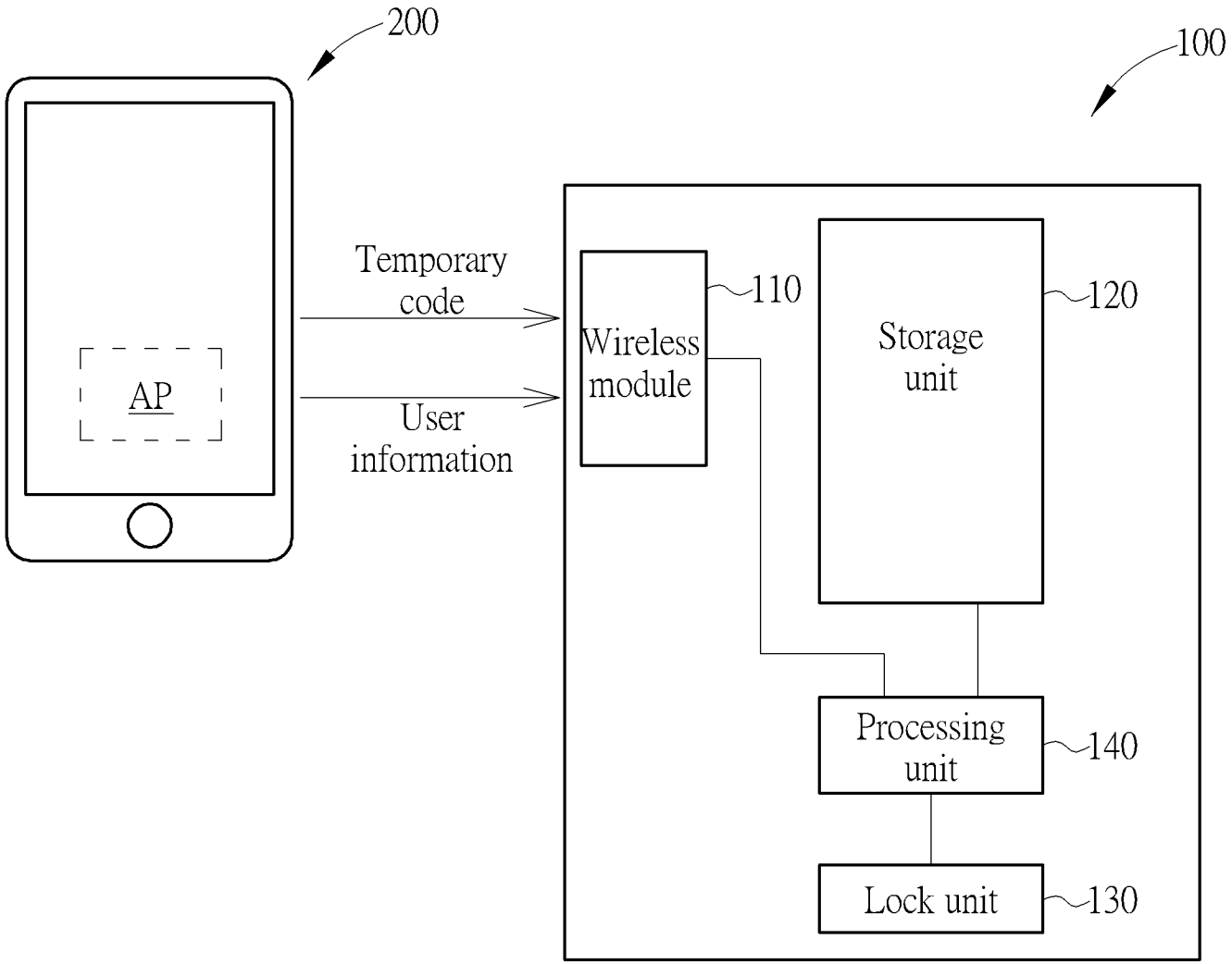
FIG. 3 is a schematic diagram illustrating inputting a temporary code and a user information to the electric lock of FIG. 1.

Please refer to FIG. 3 as well as FIG. 1 and FIG. 2. FIG. 3 is a schematic diagram illustrating inputting a temporary code and a user information to the electric lock 100 of FIG. 1. Specifically, the portable device 200 is owned by a user whom the electric lock 100 wants to add, i.e., the user is a new user who is desired/needed to be added as a new user of the electric lock 100. The user can receive the temporary code from a manager of the electric lock 100. For example, the manager can notify the user of the temporary code by e-mail, telephone or short message, and the manager can stored the temporary code in the storage unit 120 of the electric lock 100 in advance, so that the temporary code can be used as the default password for determining the identity of the user. Moreover, the portable device 200 of the user can establish a connection with the electric lock 100 via the wireless module 110 of the electric lock 100, and can communicate with the electric lock 100 via an application program AP installed in the portable device 200. For example, the user can input and transmit the temporary code to the electric lock 100 via the operation interface of the application program AP installed in the portable device 200. The processing unit 140 of the electric lock 100 determines if the temporary code matches the default password. The user can input the user information of the portable device 200 via the portable device 200 when the temporary code matches the default password and store the user information in the storage unit 120 of the electric lock 100, so that the portable device 200 is allowed to drive the electric lock 100 to perform an action. For example, the portable device 200 is allowed to drive the lock unit 130 of the electric lock 100 to perform an unlocking operation. Therefore, the user can add himself/herself as the user of the electric lock 100, and it does not require the manager to operate in person at the same time. Accordingly, the convenience for managing the electric lock 100 can be enhanced.

Figure 4:
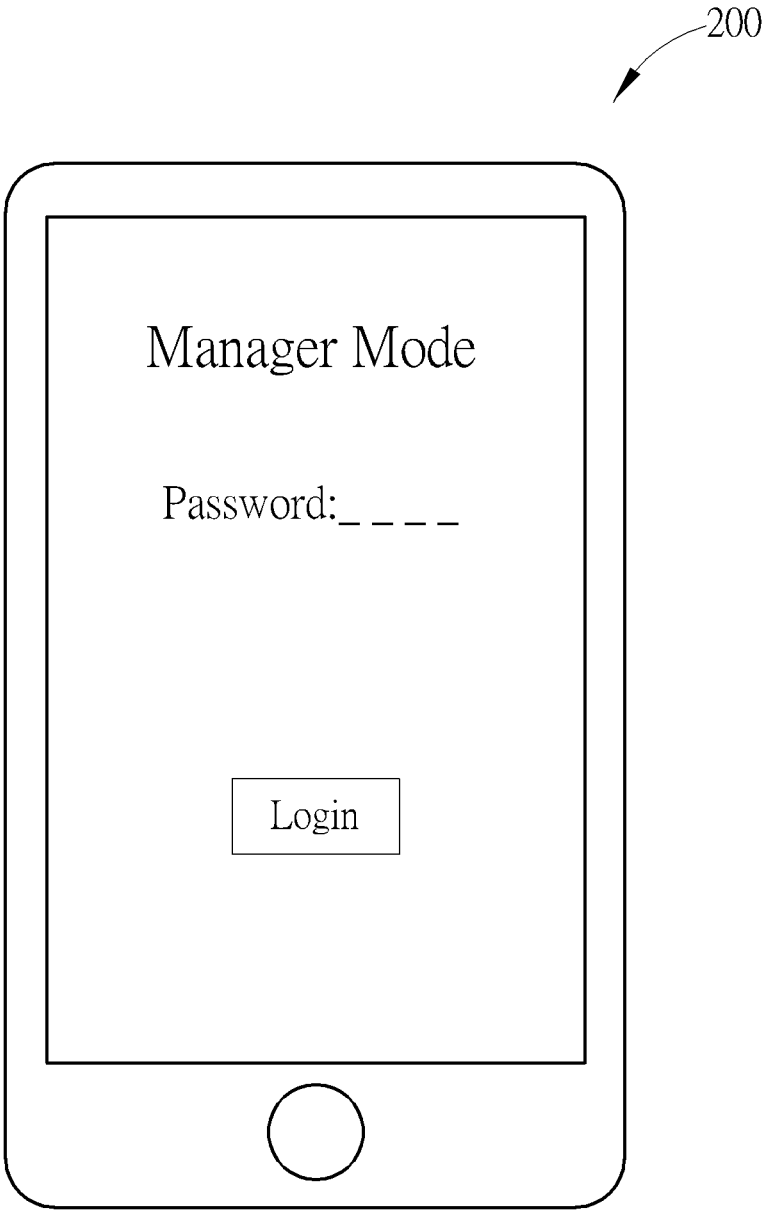
FIG. 4 is a schematic diagram illustrating a portable device entering a manager mode of the electric lock of FIG. 1.

According to an example of the present disclosure, the default password (temporary code) can be a manager password for entering a manager mode of the electric lock 100, i.e., the manager can notify the user the manager password and use the manager password as the temporary code. Please refer to FIG. 4. FIG. 4 is a schematic diagram illustrating the portable device 200 entering the manager mode of the electric lock 100 of FIG. 1. As shown in FIG. 4, the user receives the temporary code (i.e., the manager password notified by the manager), the user enters the operating interface of the manager mode of the electric lock 100 via the application program AP installed in the portable device 200, the user can input the temporary code in the column of "Password" and click "Login", then the portable device 200 can transmit the temporary code to the electric lock 100. After the wireless module 110 of the electric lock 100 receives the temporary code, the processing unit 140 of the electric lock 100 can determine if the temporary code matches the manager password. When the processing unit 140 of the electric lock 100 determines that the temporary code matches the manager password, the processing unit 140 of the electric lock 100 allows the portable device 200 to enter the manager mode of the electric lock 100.

Figure 5:
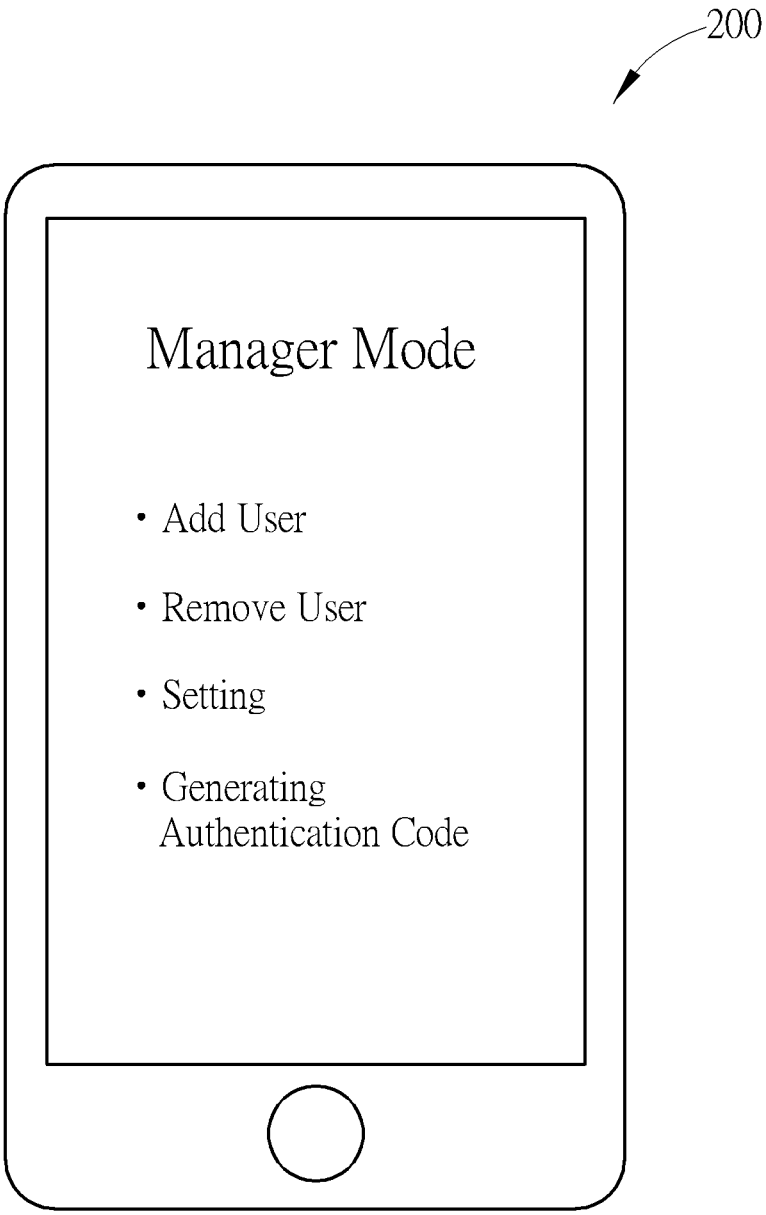
FIG. 5 is another schematic diagram illustrating the portable device entering the manager mode of the electric lock of FIG. 1.
Figure 6:
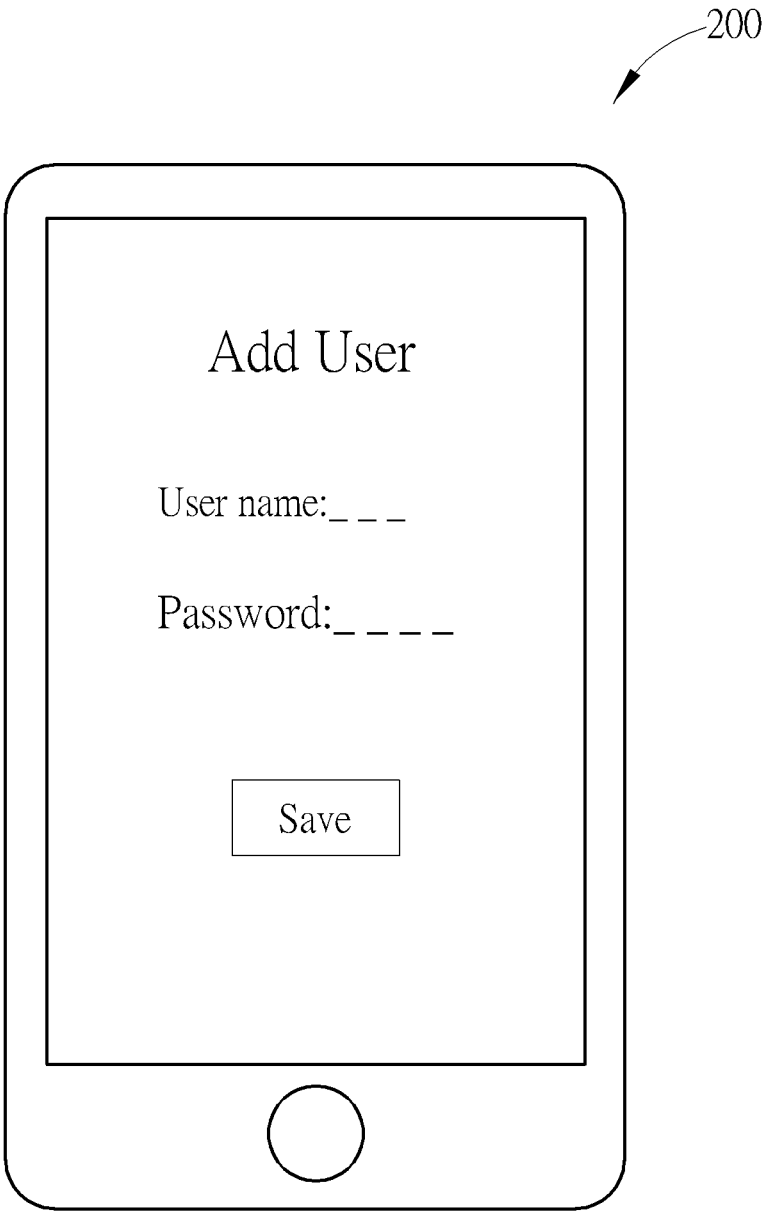
FIG. 6 is a schematic diagram illustrating the portable device entering an interface of add user of the electric lock of FIG. 1.

Please refer to FIG. 5. FIG. 5 is another schematic diagram illustrating the portable device 200 entering the manager mode of the electric lock 100 of FIG. 1. In the example, the operating interface of the manager mode includes items of "Add User", "Remove User", "Setting" and "Generating Authentication Code". The user can select the item of "Add User" in the manager mode via the portable device 200,then into an interface of add user. Please refer to FIG. 6. FIG. 6 is a schematic diagram illustrating the portable device 200 entering the interface of add user of the electric lock 100 of FIG. 1. The user can input the user information which includes "User Name" and "Password" in the example, and click "Save", then the user information can be stored in the storage unit 120 of the electric lock 100, so that the electric lock 100 can identify the portable device 200. As such, the procedure of adding the user as the user of the electric lock 100 is completed, and the portable device 200 is allow to drive the electric lock 100 to perform an action. Hereinafter, the user can drive the electric lock 100 to perform an action mode via the portable device 200. The action performed by the electric lock 100 can be, but is not limited to, an unlocking operation or a locking operation (which can refer to FIG. 8).

Figure 7:
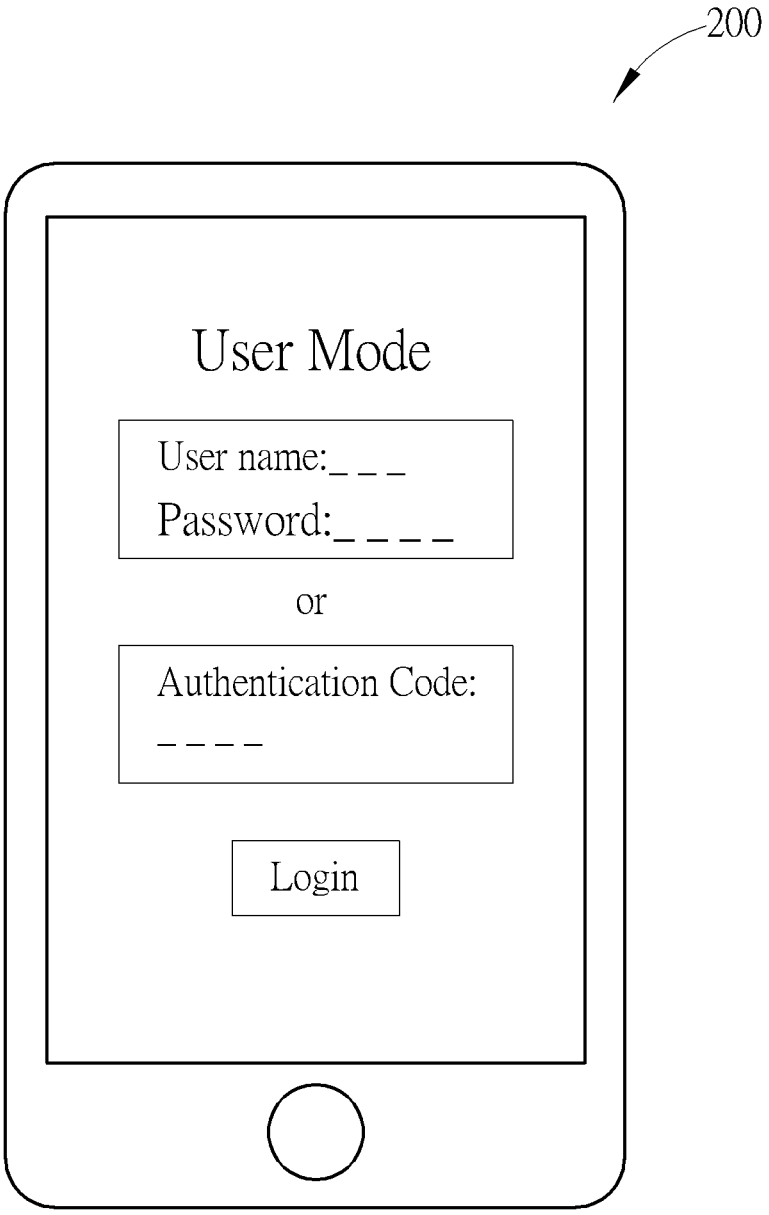
FIG. 7 is a schematic diagram illustrating the portable device entering a user mode of the electric lock of FIG. 1.

According to another example of the present disclosure, the default password (temporary code) can be an authentication code for entering a user mode of the electric lock 100. The manager can use the electric lock 100 to generate the authentication code in advance. For example, the manager can enter the manager mode of the electric lock 100 via a portable device of the manager, and select the item of "Generating Authentication Code" (shown in FIG. 5). The storage unit 120 of the electric lock 100 stored the authentication code. Then the manager can notify the user the authentication code and use the authentication code as the temporary code. Please refer to FIG. 7. FIG. 7 is a schematic diagram illustrating the portable device 200 entering a user mode of the electric lock 100 of FIG. 1. As shown in FIG. 7, the user receives the temporary code (i.e., the authentication code notified by the manager). The user enters the operating interface of the user mode of the electric lock 100 via the application program AP. As for a known user of the electric lock 100, the user can input the user name and the password in the columns of "User Name" and "Password", so as to login in the user mode. As for an unknown user (i.e., anew user), the user can input the temporary code in the column of "Authentication Code" and click "Login". When the processing unit 140 of the electric lock 100 determines that the temporary code matches the authentication code, the processing unit 140 of the electric lock 100 allows the portable device 200 to enter the user mode of the electric lock 100.

Figure 8:
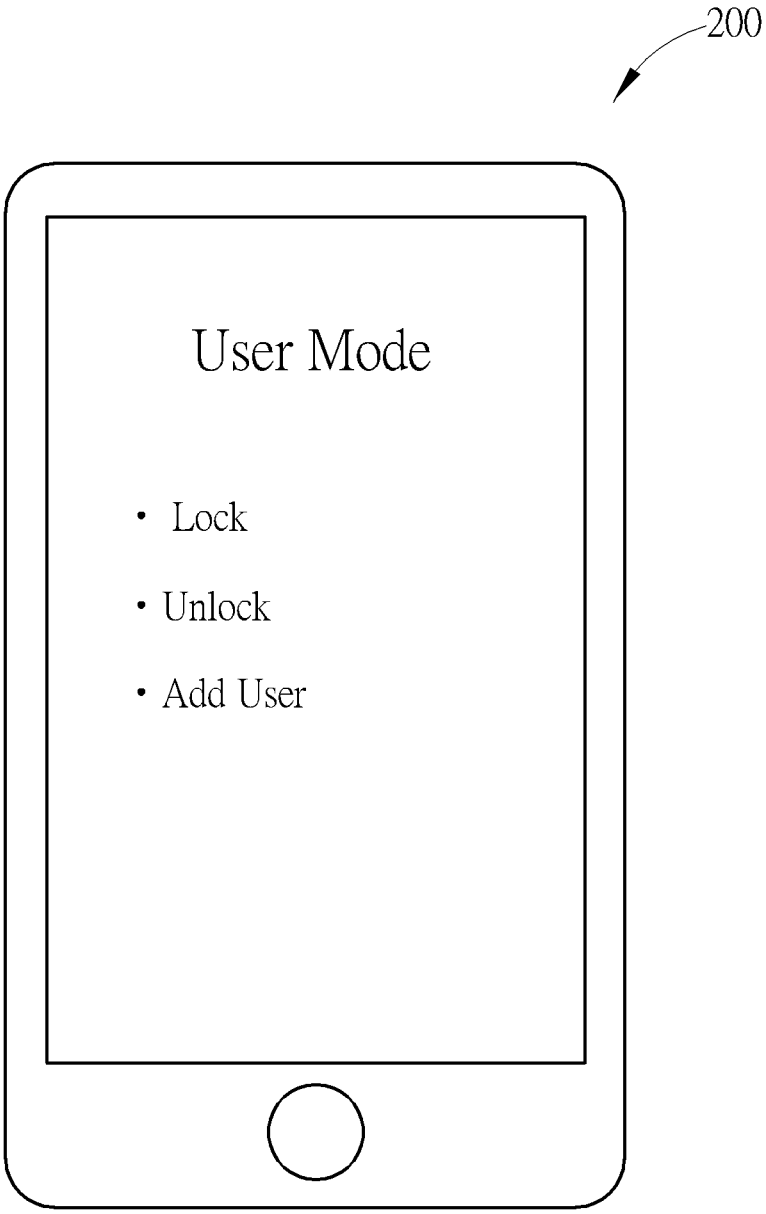
FIG. 8 is another schematic diagram illustrating the portable device entering the user mode of the electric lock of FIG. 1.

Please refer to FIG. 8. FIG. 8 is another schematic diagram illustrating the portable device 200 entering the user mode of the electric lock 100 of FIG. 1. In the example, the interface of the user mode includes items of "Lock", "Unlock" and "Add User". The user can select the item of "Add User" of the user mode via the portable device 200, and enter the interface of add user. The interface of add user is shown in FIG. 6, and description related thereto is not repeated herein. Then the user information can be stored in the storage unit 120 of the electric lock 100, so that the electric lock 100 can identify the portable device 200. As such, the procedure of adding the user as the user of the electric lock 100 is completed, and the portable device 200 is allow to drive the electric lock 100 to perform an action. Hereinafter, the user can drive the electric lock 100 to perform an action mode via the portable device 200. The action performed by the electric lock 100 can be, but is not limited to, an unlocking operation or a locking operation (which can refer to FIG. 8).

The items and the layouts of the aforementioned interfaces of manager mode, add user and user mode are only exemplary and can be adjusted accordingly to practical needs, and the present invention is not limited thereto. The manager can further set the valid time of the temporary code. When the time inputting the temporary code exceeds the valid time, the processing unit 140 of the electric lock 100 controls the wireless module 110 to stop the connection with the portable device 200, so that the user is not allow to input the user information of the portable device 200 via the portable device 200, and thus is not allowed to add himself/herself as the user of the electric lock 100. Specifically, when the user information is not stored in the storage unit 120 of the electric lock 100 within a predetermined time (i.e., within the valid time), the processing unit 140 of the electric lock 100 controls the wireless module 110 of the electric lock 100 to stop the connection with the portable device 200. The user information not being stored in the storage unit 120 of the electric lock 100 includes the processing unit 140 of the electric lock 100 determining that the time inputting the temporary code exceeds the valid time, or the processing unit 140 of the electric lock 100 determining that the temporary code does not match the default password or the user does not input and transmit the temporary code to the electric lock 100 via the portable device 200 (for example, the portable device 200 is idle for a period of time, i.e., the user does not perform the input to the portable device 200).

With the valid time of the temporary code, the manager only allow other people to add user of the electric lock 100 in a predetermined time, which can ensure the safety of the electric lock 100. Furthermore, when the temporary code is the manager code, the storage unit 120 can store the unique identification information of the portable device of the manager in advance for preventing the manager cannot enter the manager mode with the manager password when exceeding the valid time. As such, the manager can enter the manager mode of the electric lock 100 with the unique identification information of the portable device thereof, and can select the item of "Setting" so as to enter an interface of setting (not shown) to set a new manager password.

The connection between the portable device 200 and the electric lock 100 can be through a wireless personal area network (WPAN), such as Bluetooth module. That is, the connection between the portable device 200 and the electric lock 100 is point to point, and thus does not need the wireless local area network (WLAN). As such, the electric lock 100 can be operated in an environment without the wireless local area network, which can reduce the standard for the operation environment of the electric lock 100.

When the user information is stored in the electric lock 100, the electric lock 100 can further receive and store a unique identification information of the portable device 200. Therefore, when the connection between the portable device 200 and the electric lock 100 is established, the electric lock 100 can determine if the portable device 200 is allowed to drive the electric lock 100 to perform an action by the unique identification information of the portable device 200. Accordingly, the user needs not to input the user information via the application program AP, which can significantly enhance the convenience. The unique identification information can be a universally unique identifier (UUID).

Figure 9:
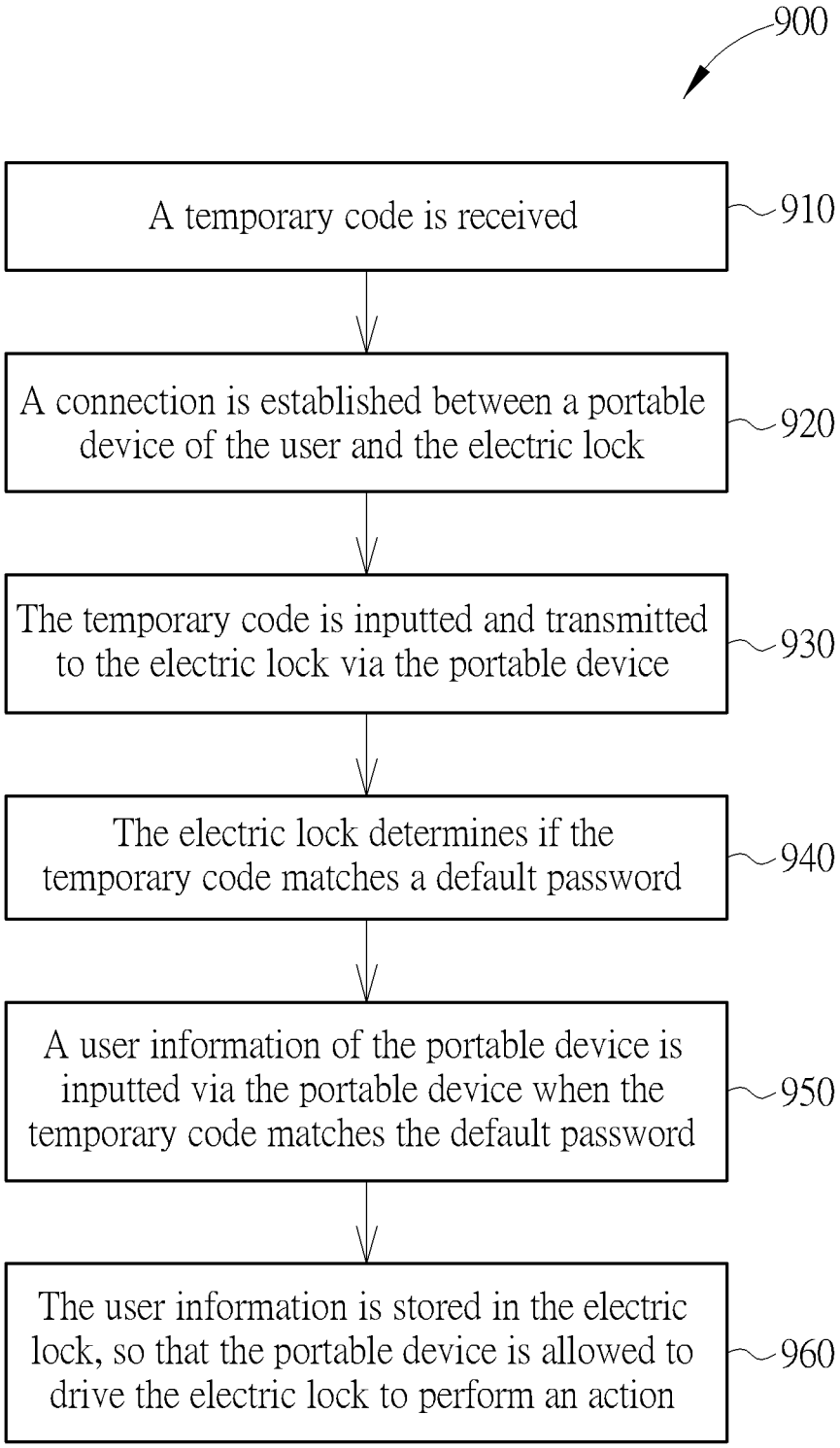
FIG. 9 is a flowchart illustrating a method for adding a user of an electric lock according to another embodiment of the present invention.

Please refer to FIG. 9. FIG. 9 is a flowchart illustrating a method 900 for adding a user of an electric lock according to another embodiment of the present invention. In FIG. 9, the method 900 includes Step 910, Step 920, Step 930, Step 940, Step 950 and Step 960.

In Step 910, a temporary code is received.

In Step 920, a connection is established between a portable device of the user and the electric lock.

In Step 930, the temporary code is inputted and transmitted to the electric lock via the portable device.

In Step 940, the electric lock determines if the temporary code matches a default password.

In Step 950, a user information of the portable device is inputted via the portable device when the temporary code matches the default password.

In Step 960, the user information is stored in the electric lock, so that the portable device is allowed to drive the electric lock to perform an action.

Comparing to the prior art, the user who is desired/needed to be added as a new user of the electric lock can add himself/herself as the new user of the electric lock via the user's own portable device, and it does not require the manager to operate in person at the same time. Accordingly, the convenience for managing the electric lock can be enhanced. Furthermore, when the connection between the electric lock and the portable device is through the wireless personal area network, the electric lock can be operated in the environment without wireless local area network, which can reduce the standard for the operation environment of the electric lock.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for adding a user of an electric lock, comprising:

receiving a temporary code from a portable device of the user;

establishing a connection between the portable device of the user and the electric lock;

inputting and transmitting the temporary code to the electric lock via the portable device;

the electric lock determining if the temporary code matches a default password from the electric lock;

inputting a user information of the portable device via the portable device when the temporary code matches the default password; and storing the user information in the electric lock, so that the portable device is allowed to drive the electric lock to perform an action.

2. The method of claim 1, wherein:

the default password is a manager password for entering a manager mode of the electric lock;

the electric lock determining if the temporary code matches the default password comprises the electric lock determining if the temporary code matches the manager password;

the electric lock allows the portable device to enter the manager mode of the electric lock when the temporary code matches the manager password; and the user inputs the user information in the manager mode via the portable device.

3. The method of claim 1, further comprising:

the electric lock generating an authentication code for entering a user mode of the electric lock.

4. The method of claim 3, wherein:

the default password is the authentication code for entering the user mode of the electric lock;

the electric lock determining if the temporary code matches the default password comprises the electric lock determining if the temporary code matches the authentication code;

the electric lock allows the portable device to enter the user mode of the electric lock when the temporary code matches the authentication code; and the user inputs the user information in the user mode via the portable device.

5. The method of claim 1, further comprising:

stopping the connection between the electric lock and the portable device when the user information is not stored in the electric lock within a predetermined time.

6. The method of claim 5, wherein:

the user information not being stored in the electric lock comprises the electric lock determining that the temporary code does not match the default password.

7. The method of claim 5, wherein:

the user information not being stored in the electric lock comprises the temporary code not being inputted and transmitted to the electric lock via the portable device.

8. The method of claim 1, wherein:

the connection between the portable device and the electric lock is through a wireless personal area network (WPAN).

9. The method of claim 1, further comprising:

the electric lock receiving and storing a unique identification information of the portable device.

10. An electric lock, when establishing a connection with a portable device of a user desired to be added, the electric lock being configured to:

receive a temporary code transmitted from the portable device;

determine if the temporary code matches a default password from the electric lock;

receive a user information of the portable device inputted via the portable device when the temporary code matches the default password; and store the user information, so that the portable device is allowed to drive the electric lock to perform an action.

11. The electric lock of claim 10, wherein the default password is a manager password for entering a manager mode of the electric lock, and the electric lock is configured to:

determine if the temporary code matches the manager password;

allow the portable device to enter the manager mode of the electric lock when the temporary code matches the manager password; and receive the user information inputted by the user in the manager mode via the portable device.

12. The electric lock of claim 10, further being configured to:

generate an authentication code for entering a user mode of the electric lock.

13. The electric lock of claim 12, further being configured to:

determine if the temporary code matches the authentication code;

allow the portable device to enter the user mode of the electric lock when the temporary code matches the authentication code; and receive the user information inputted by the user in the user mode via the portable device.

14. The electric lock of claim 10, comprising:

a wireless module;

a storage unit;

a lock unit; and a processing unit electrically connected with the wireless module, the storage unit and the lock unit;

wherein the storage unit stores the default password, the wireless module receives the temporary code transmitted from the portable device, the processing unit determines if the temporary code matches the default password, the processing unit controls the wireless module to receive the user information of the portable device inputted via the portable device when the temporary code matches the default password, the storage unit stores the user information, so that the portable device is allowed to drive the lock unit of the electric lock to perform the action.

15. The electric lock of claim 14, wherein:

the default password is a manager password for entering a manager mode of the electric lock;

the processing unit determines if the temporary code matches the manager password;

the processing unit allows the portable device to enter the manager mode of the electric lock when the temporary code matches the manager password; and the processing unit controls the wireless module to receive the user information inputted by the user in the manager mode via the portable device.

16. The electric lock of claim 14, wherein:

the default password is an authentication code for entering a user mode of the electric lock;

the processing unit determines if the temporary code matches the authentication code;

the processing unit allows the portable device to enter the user mode of the electric lock when the temporary code matches the authentication code; and the processing unit controls the wireless module to receive the user information inputted by the user in the user mode via the portable device.

17. The electric lock of claim 14, wherein:

the processing unit controls the wireless module to stop the connection with the portable device when the user information is not stored in the storage unit of the electric lock within a predetermined time.

18. The electric lock of claim 17, wherein:

the user information not being stored in the storage unit of the electric lock comprises the processing unit of the electric lock determining that the temporary code does not match the default password.

19. The electric lock of claim 10, wherein:

the connection between the electric lock and the portable device is through a wireless personal area network (WPAN).

20. The electric lock of claim 10, wherein:

the wireless module of the electric lock receives a unique identification information of the portable device and the storage unit of the electric lock stores the unique identification information of the portable device.

* * * * *